US008351814B2

(12) United States Patent
Kasuga

(10) Patent No.: US 8,351,814 B2
(45) Date of Patent: Jan. 8, 2013

(54) IMAGE FORMING APPARATUS WITH FAN FOR BLOWING AIR TO TRANSFER SHEET

(75) Inventor: Akio Kasuga, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 263 days.

(21) Appl. No.: 12/820,849

(22) Filed: Jun. 22, 2010

(65) Prior Publication Data

US 2010/0329726 A1 Dec. 30, 2010

(30) Foreign Application Priority Data

Jun. 29, 2009 (JP) ..... 2009-153773

(51) Int. Cl.
*G03G 21/20* (2006.01)

(52) U.S. Cl. ..... 399/92; 399/320; 399/406; 399/407

(58) Field of Classification Search ..... 399/92, 399/320, 406, 407
See application file for complete search history.

(56) References Cited

U.S. PATENT DOCUMENTS

| | | | |
|---|---|---|---|
| 6,522,841 | B2 | 2/2003 | Horikoshi |
| 2005/0191070 | A1 | 9/2005 | Izawa et al. |
| 2006/0285900 | A1 | 12/2006 | Kurita |
| 2009/0190981 | A1 * | 7/2009 | Tanaka ..... 399/397 |

FOREIGN PATENT DOCUMENTS

| | | | |
|---|---|---|---|
| JP | 07069489 A | * | 3/1995 |
| JP | 9-281833 | | 10/1997 |
| JP | 2000-95414 | | 4/2000 |
| JP | 2004-4746 | | 1/2004 |
| JP | 2004-45723 | | 2/2004 |
| JP | 2005-7769 | | 1/2005 |
| JP | 2005-242189 | | 9/2005 |
| JP | 2006-133310 | | 5/2006 |
| JP | 2006-163193 | | 6/2006 |
| JP | 2006-350244 | | 12/2006 |

OTHER PUBLICATIONS

English Abstract, JP 07069489 A, Hatano, Mar. 1995.*
Japanese Examiner's Decision of Refusal, mailed Oct. 18, 2011, directed to Japanese Patent Application No. 2009-153773; 8 pages.
Japanese Office Action mailed May 17, 2011, directed to corresponding application JP-2009-153773; 6 pages.

* cited by examiner

*Primary Examiner* — Ryan Walsh
(74) *Attorney, Agent, or Firm* — Morrison & Foerster LLP

(57) ABSTRACT

An image forming apparatus comprises a fixing part for fixing a toner image formed on a transfer material to the transfer material, a fan provided on the downstream side of the fixing part, for blowing air to the transfer material having passed through the fixing part, and an airflow control part for controlling the amount of air to be blown from the fan. When the basis weight of the transfer material is larger than a first threshold value, the airflow control part sets the amount of air to be blown to a value smaller than that in a case where the basis weight of the transfer material is smaller than the first threshold value.

10 Claims, 11 Drawing Sheets

IMAGE FORMING APPARATUS WITH FAN FOR BLOWING AIR TO TRANSFER SHEET

This application is based on Japanese Patent Application No. 2009-153773 filed on Jun. 29, 2009, the contents of which are hereby incorporated by reference.

BACKGROUND OF THE INVENTION

1. Field of the Invention

The present invention relates to an image forming apparatus such as a laser beam printer.

2. Description of the Background Art

In an image forming apparatus (a laser beam printer and the like), a large amount of heat is given by a fixing unit or the like, to thereby fix a toner image formed on paper to the paper. Then, the paper having passed through the fixing unit further passes through a conveyance roller pair for output, to be outputted on a paper output tray.

In continuous printing wherein a plurality of printed matters are continuously outputted, the plurality of printed matters (sheets of paper) are stacked on the paper output tray. At that time, the sheets of paper on the paper output tray have considerably high temperature. For this reason, there occur some phenomena where a toner image on a sheet of paper among the plurality of stacked sheets of paper is adhered to another sheet of paper, where adjacent sheets of paper are adhered to each other through the mediation of a toner image on one sheet of paper, and the like. These phenomena may cause degradation of the image and are considered to be disadvantageous.

In order to avoid these phenomena, there is a technique of blowing air to sheets of paper having been subjected to a fixing process in order to cool these sheets of paper. For example, an image forming apparatus disclosed in Japanese Patent Application Laid Open Gazette No. 2000-95414 (Patent Document 1) comprises a cooling fan for blowing air to sheets of paper to be outputted to a paper output tray. In Patent Document 1, the amount of air to be blown from the cooling fan is controlled to be relatively large when OHP sheets are outputted and the amount of air to be blown from the cooling fan is controlled to be relatively small when sheets of plain paper are outputted.

In an image forming apparatus such as a laser beam printer, sheets of paper having different thickness, such as plain paper and thick paper, are used.

In printing of thick paper, generally, by controlling the fixing speed to be relatively low, a sufficient amount of heat can be given to the sheet of paper (see e.g., Japanese Patent Application Laid Open Gazette No. 9-281833 (Patent Document 2)).

When the fixing speed is set to be low in printing of thick paper, however, the image forming speed also becomes low.

Therefore, in order to suppress a decrease in the image forming speed, it is preferable that the fixing process should be performed, accompanying high-speed conveyance.

Also in such a fixing process accompanying high-speed conveyance, in order to avoid degradation of an image due to adhesion of the image or the like, there is a possible case where air is blown to cool the sheet of paper.

The inventor of the present invention has learned, however, that when the same amount of air is blown to both the thick paper and the plain paper in the fixing process accompanying high-speed conveyance, either one type of paper cannot be appropriately cooled. The inventor also has learned that even if the amount of air to be blown from the cooling fan is controlled to be small when sheets of plain paper which are relatively thin are outputted, it is not possible to perform appropriate cooling.

SUMMARY OF THE INVENTION

Then, it is an object of the present invention to provide an image forming apparatus capable of performing an appropriate cooling process for sheets of paper which have different thickness in a case where a fixing process is performed accompanying high-speed conveyance, and a technique relevant thereto.

The present invention is intended for an image forming apparatus. According to a first aspect of the present invention, the image forming apparatus comprises a fixing part for fixing a toner image formed on a transfer material to the transfer material, a fan provided on the downstream side of the fixing part, for blowing air to the transfer material having passed through the fixing part, and an airflow control part for controlling the amount of air to be blown from the fan, and in the image forming apparatus of the present invention, when the basis weight of the transfer material is larger than a first threshold value, the airflow control part sets the amount of air to be blown to a value smaller than that in a case where the basis weight of the transfer material is smaller than the first threshold value.

According to a second aspect of the present invention, the image forming apparatus comprises a fixing part for fixing a toner image formed on a transfer material to the transfer material, a fan provided on the downstream side of the fixing part, for blowing air to the transfer material having passed through the fixing part, and an airflow control part for controlling the amount of air to be blown from the fan, and in the image forming apparatus of the present invention, in a case where a first transfer material which is a transfer material having a basis weight smaller than a first threshold value and a second transfer material which is a transfer material having a basis weight larger than the first threshold value each pass through the fixing part at substantially the same speed, the airflow control part sets the amount of air to be blown to the second transfer material to a value smaller than the amount of air to be blown to the first transfer material.

The present invention is also intended for an image forming method. According to a third aspect of the present invention, the image forming method comprises the steps of a) fixing a toner image formed on a transfer material to the transfer material by using a fixing part, and b) blowing air to the transfer material having passed through the fixing part by using a fan provided on the downstream side of the fixing part, and in the image forming method of the present invention, when the basis weight of the transfer material is larger than a first threshold value, the amount of air to be blown from the fan is set to a value smaller than that in a case where the basis weight of the transfer material is smaller than the first threshold value.

These and other objects, features, aspects and advantages of the present invention will become more apparent from the following detailed description of the present invention when taken in conjunction with the accompanying drawings.

DESCRIPTION OF THE PREFERRED EMBODIMENTS

Now, the preferred embodiment of the present invention will be discussed with reference to figures.

<1. Overview of Apparatus>

Figure 1:
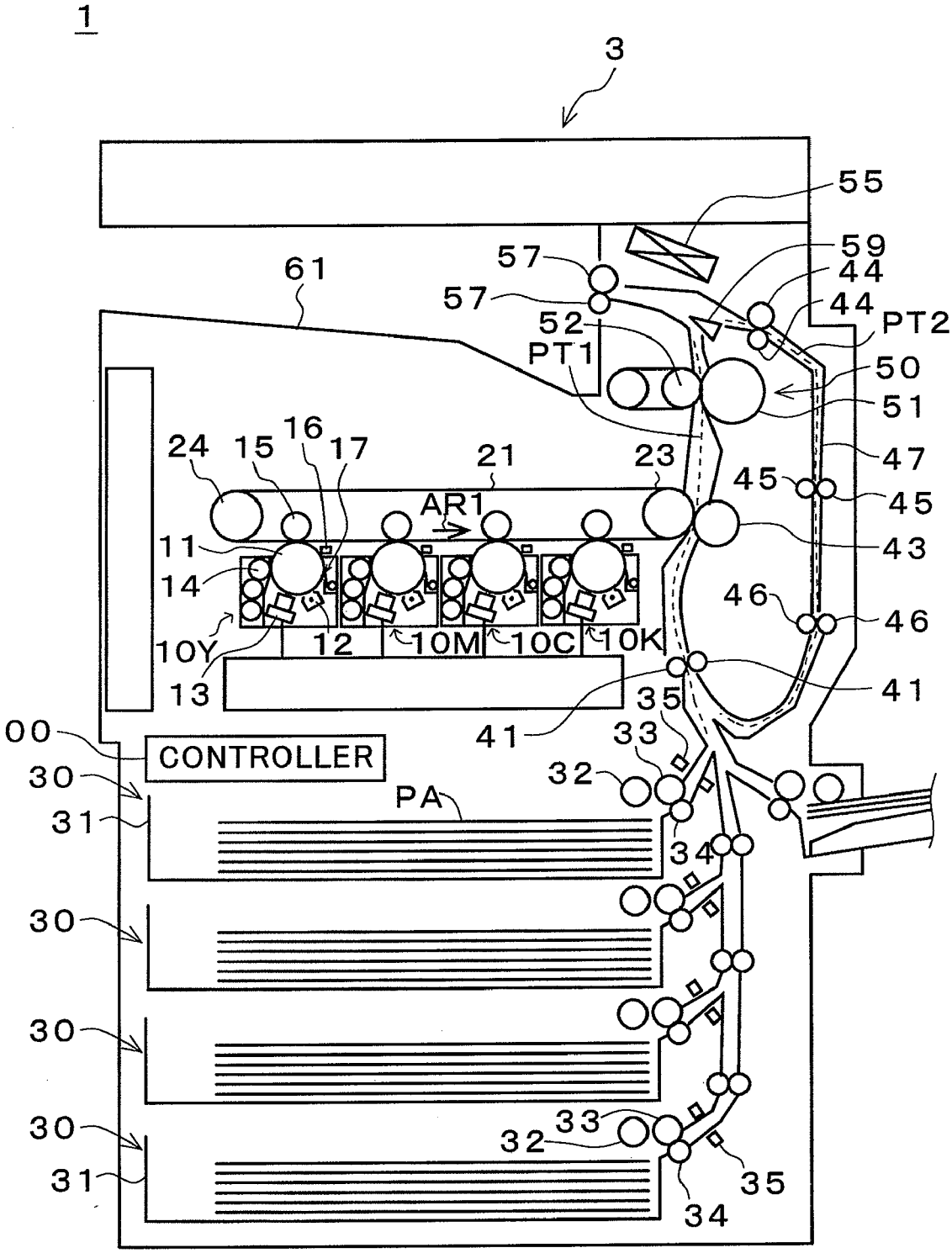
FIG. 1 is a view showing a general configuration of an image forming apparatus.

FIG. 1 is a view showing a general configuration of an image forming apparatus 1 in accordance with the preferred embodiment. The image forming apparatus 1 is an apparatus which forms an image by developing an electrostatic latent image on an image support. Herein, as an example of the image forming apparatus, shown is an electrophotographic printer, and in more detail, a tandem-type full color printer.

The image forming apparatus 1 serves as a color page printer by printing out an image with a printing mechanism described later. The image is based on image data transmitted from an information processing apparatus (personal computer or the like) connected to the image forming apparatus 1 via a network or the like. The image forming apparatus 1 also serves as a copier by printing out image data on an original document with the printing mechanism. The image data on an original document is read by a scanner 3 (optical reader) provided at an upper portion of the image forming apparatus 1.

As shown in FIG. 1, the image forming apparatus 1 comprises a plurality of (specifically, four) imaging units 10 (in detail, 10Y, 10M, 10C, and 10K). Specifically, the image forming apparatus 1 comprises a yellow imaging unit 10Y, a magenta imaging unit 10M, a cyan imaging unit 10C, and a black imaging unit 10K. Each of the imaging units 10 forms an image of the corresponding color component (specifically, any one of the color components Y (yellow), M (magenta), C (cyan), and K (black)) out of a final output image by electrophotographic method and transfers the image onto an intermediate transfer belt (also referred to as an intermediate transfer member) 21. Then, the image of the color components superimposed on the intermediate transfer belt 21 is further transferred onto a sheet of paper (also referred to as a transfer material) PA passing through a conveyance path PT1 (described later), to thereby form a full color image on the sheet of paper PA. The intermediate transfer belt 21 also serves as an image support for temporarily supporting a toner image transferred from each photosensitive material 11 (described later).

The four imaging units 10 (10Y, 10M, 10C, and 10K) are provided mainly below a lower straight portion of the intermediate transfer belt 21 which is wound around a driving roller 23 and a winding roller 24, being arranged in series along the lower straight portion of the intermediate transfer belt 21. Each of the imaging units 10 has the photosensitive material 11, a charger 12, an exposure unit 13, a developing unit 14, a first transfer unit (primary transfer unit) 15, an eraser (static eliminator) 16, and a cleaner 17. In more detail, in each imaging unit 10, the charger 12, the exposure unit 13, the developing unit 14, the first transfer unit 15, the eraser 16, and the cleaner 17 are arranged in a clockwise direction in this order around the outer perimeter of the substantially cylindrical photosensitive material 11. Among these elements, the first transfer unit (in more detail, a transfer roller (primary transfer roller)) 15 is arranged to be opposed to the photosensitive material 11 with the intermediate transfer belt 21 interposed therebetween.

Being driven by the driving roller 23, the intermediate transfer belt 21 is moved in the direction of the arrow AR1. Opposite to the driving roller 23, provided is a second transfer unit (transfer roller (secondary transfer roller)) 43 with the intermediate transfer belt 21 interposed therebetween. In accordance with voltage application by the transfer roller 43, the toner image (full color toner image or the like) on the intermediate transfer belt 21 is transferred onto the sheet of paper PA.

Further, a fixing part (fixing unit) 50 is provided in the downstream of the direction of the conveyance of the sheet of paper PA having passed through the positions of the driving roller 23 and the transfer roller 43. The fixing part 50 gives heat to the sheet of paper PA to fix the toner image formed on the sheet of paper PA to the sheet of paper PA.

Further, a paper output tray 61 is provided on the downstream side of the fixing part 50 in the direction of the conveyance.

On the lower side of the imaging units 10 and the transfer roller 43 (in the upstream of the conveyance path), provided are a plurality of paper feed parts 30. Each of the paper feed parts 30 comprises a paper feed tray 31, a pickup roller 32, a paper feed roller 33, and a flip-through roller 34 and is capable of feeding paper PA toward a timing roller 41 and the transfer roller 43.

Each paper feed part 30 further comprises a sensor 35 for detecting the basis weight of the sheet of paper. The sensor 35 detects the light transmittance and the like of the sheet of paper PA passing near the sensor 35 by using a projector part and a light receiving part thereof. The sensor 35 detects the basis weight of the sheet of paper PA (in other words, the thickness of the sheet of paper PA) on the basis of the light transmittance and the like. Though discussion is made herein on the case of detecting the basis weight of the sheet of paper PA with the sensor 35, detection of the basis weight is not limited to this case. For example, the basis weight of the sheet of paper PA may be detected on the basis of the driving current of the paper feed roller 33.

The image forming apparatus 1 further comprises the conveyance path PT1 leading toward a paper output roller pair (57, 57) through roller pairs (41, 41), (23, 43), and (51, 52), as shown in FIG. 1. The conveyance path PT1 is formed of the roller pairs (41, 41), (23, 43), and (51, 52) and a guide member provided between the respective roller pairs, and the like.

In single-sided printing, the sheet of paper PA is conveyed to the paper output tray 61 through the conveyance path PT1. Specifically, the toner image on the intermediate transfer belt 21 is transferred on one-side surface (left-side surface in FIG. 1) of the sheet of paper PA by the transfer roller 43 and subjected to a fixing process by the fixing part 50. After that, the sheet of paper PA is moved to the vicinity of the paper output roller pair (57, 57) and then conveyed to the paper output tray 61 provided in the further downstream.

The image forming apparatus 1 further comprises an inverting conveyance path PT2. The inverting conveyance path PT2 is formed of roller pairs (44, 44), (45, 45), and (46, 46) and a guide member 47 provided between the respective roller pairs, and the like. The inverting conveyance path PT2 is a path for inverting the orientation of the sheet of paper while conveying the sheet of paper PA and serves as an alternative path for connecting the sheet of paper to the ordinary conveyance path PT1 again. By using also the inverting conveyance path PT2, the image forming apparatus 1 can perform a double-sided printing operation.

In double-sided printing, the toner image on the intermediate transfer belt 21 is transferred on a first surface (left-side surface in FIG. 1) of the sheet of paper PA by the transfer roller 43 and subjected to the fixing process by the fixing part 50. After that, the sheet of paper PA is moved further to the downstream while being held by the paper output roller pair (57, 57). When a paper output sensor 54 (FIG. 2) thereafter detects the passing of the rear end of the sheet of paper PA through the vicinity of the paper output sensor 54, however, the direction of the rotation of the paper output roller pair (57, 57) is reversed while the paper output roller pair (57, 57) holds the sheet of paper PA. Then, the sheet of paper PA is moved in the reverse direction (in the right direction of FIG. 2) in accordance with the reverse driving of the paper output roller pair (57, 57). In the destination (on the right side) of the sheet of paper PA, provided is a switching mechanism 59 for switching the travelling direction of the sheet of paper. By moving the switching mechanism 59 to a predetermined position, the entry of the sheet of paper PA into the conveyance path PT1 is prevented and the sheet of paper goes toward the inverting conveyance path PT2. When the sheet of paper PA goes along the inverting conveyance path PT2, the surface of the sheet of paper PA to face the intermediate transfer belt 21 is changed. Specifically, the first surface (e.g., the front surface) of the sheet of paper having been present on the left side in the vicinity of the driving roller 23 (and the lower side in the vicinity of the paper output rollers 57) in the conveyance path PT1 in the printing of the first surface comes to be present on the right side in the vicinity of driving roller 23 (and the upper side in the vicinity of the paper output rollers 57) in the conveyance path PT1. In other words, when the sheet of paper passes through the conveyance path PT1 again after passing through the inverting conveyance path PT2, a second surface (e.g., the back surface) of the sheet of paper is present on the left side in the vicinity of the driving roller 23 (and the lower side in the vicinity of the paper output rollers 57) to be allowed to come into contact with the intermediate transfer belt 21. Thus, when the sheet of paper passes through the inverting conveyance path PT2, the surface to be brought into contact with the intermediate transfer belt 21 is inverted and the second surface of the sheet of paper PA becomes a surface to be printed. Then, the toner image on the intermediate transfer belt 21 is transferred to the second surface of the sheet of paper PA and subjected to the fixing process by the fixing part 50. After that, the sheet of paper PA is moved to the vicinity of the paper output roller pair (57, 57) and then conveyed to the paper output tray 61 provided in the further downstream. Thus, the image forming apparatus 1 can transfer the toner images on the intermediate transfer belt 21 to the front and back surfaces of the sheet of paper PA, respectively, and in other words, can perform the double-sided printing operation.

Figure 2:
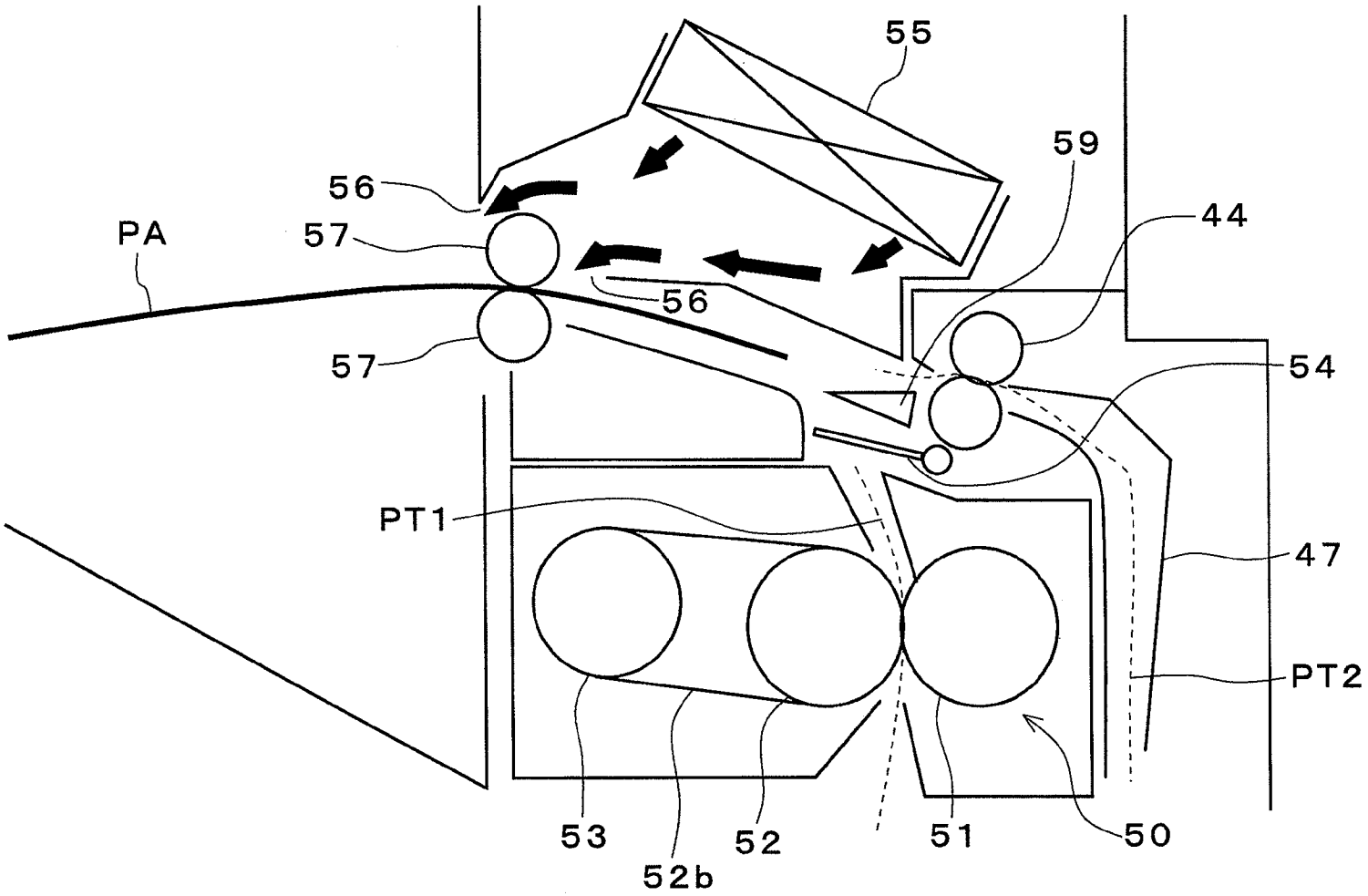
FIG. 2 is a cross section showing a general configuration of a fixing part and the vicinity thereof.

Next, discussion will be made on a configuration of the fixing part 50 and the vicinity thereof and the like, with reference to FIG. 2. FIG. 2 is a cross section showing a general configuration of the fixing part 50 and the vicinity thereof.

As shown in FIG. 2, the fixing part 50 comprises a pair of fixing rollers 51 and 52. The fixing roller 52 is driven by a driving roller 53 and a winding roller 52*b* to rotate.

The fixing rollers 51 and 52 each incorporate a heater for giving heat and the temperatures of the fixing rollers 51 and 52 are increased by the respective heaters. The temperatures of the fixing rollers 51 and 52, i.e., the temperature of the fixing part 50, are controlled by a fixing temperature control part 111 (see FIG. 3).

On the downstream side of the fixing part 50, provided are the paper output sensor 54 and the pair of paper output rollers 57.

Further, on the downstream side of the fixing part 50 (in more detail, in the vicinity above the paper output rollers 57), provided are a fan 55 for cooling the sheet of paper and an air blowing opening (air blowing port) 56. The fan 55 blows air generated by the rotation of the blades of the fan 55 from the air blowing opening 56 toward the sheet of paper PA (in more detail, the upper-side surface thereof) passing through the paper output rollers 57 and the vicinity thereof after passing through the fixing part 50. The sheet of paper PA of which the temperature is increased by the heat given by the fixing part 50 is cooled by the air blown from the fan 55.

In this preferred embodiment, the fan 55 is provided only on the side of one surface (specifically, the upper surface) of the sheet of paper PA on the downstream side of the fixing part 50. Therefore, as compared with a case where fans are provided on both sides of the transfer material, the configuration of the apparatus can be simplified. This also contributes to the downsizing of the apparatus.

The rotation speed of the fan 55 is controlled by an airflow control part 112 (see FIG. 3) and the like.

Figure 3:
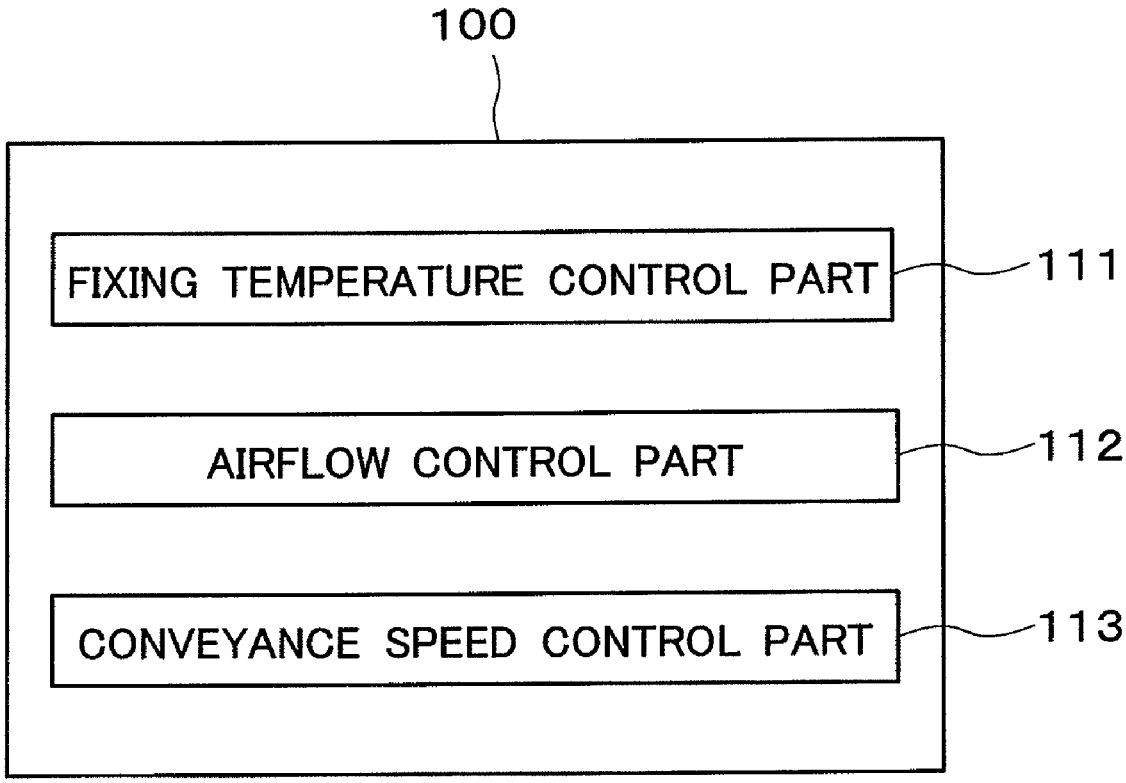
FIG. 3 is a view showing functional blocks in a controller (control part)

FIG. 3 is a view showing functional blocks in a control part (controller) 100 of the image forming apparatus 1. As shown in FIG. 3, the control part 100 comprises various functioning parts, i.e., the fixing temperature control part 111, the airflow control part 112, a conveyance speed control part 113 and the like. The control part 100 is physically configured of a CPU, a semiconductor memory and the like.

The fixing temperature control part 111 controls the amount of electricity to be supplied to the heaters incorporated in the fixing rollers 51 and 52, and the like, to thereby control the temperatures of the fixing rollers 51 and 52 (in other words, the temperature of the fixing part 50).

The airflow control part 112 control the amount of air to be blown from the fan 55 by changing the rotation speed of the fan 55. As discussed later, by controlling the amount of air to be blown, the sheet of paper PA can be appropriately cooled.

The conveyance speed control part 113 controls the respective rotation speeds of the rollers 23, 43, 51 and 52 and the like, to thereby control the conveyance speed for the sheet of paper PA. In the image forming apparatus 1, the conveyance speed for the sheet of paper PA can be controlled by the conveyance speed control part 113 and the like in a multistep manner.

<2. Cooling of Paper>

FIGS. 4 to 11 are conceptual diagrams each showing the cross section of the sheet of paper PA. FIGS. 4 to 7 each show the cross section of a sheet of paper (also referred to as a thick sheet of paper) PA1 having a basis weight larger than a predetermined value, and FIGS. 8 to 11 each show the cross section of a sheet of paper (also referred to as a thin sheet of paper) PA0 having a basis weight smaller than a predetermined value.

Figure 4:
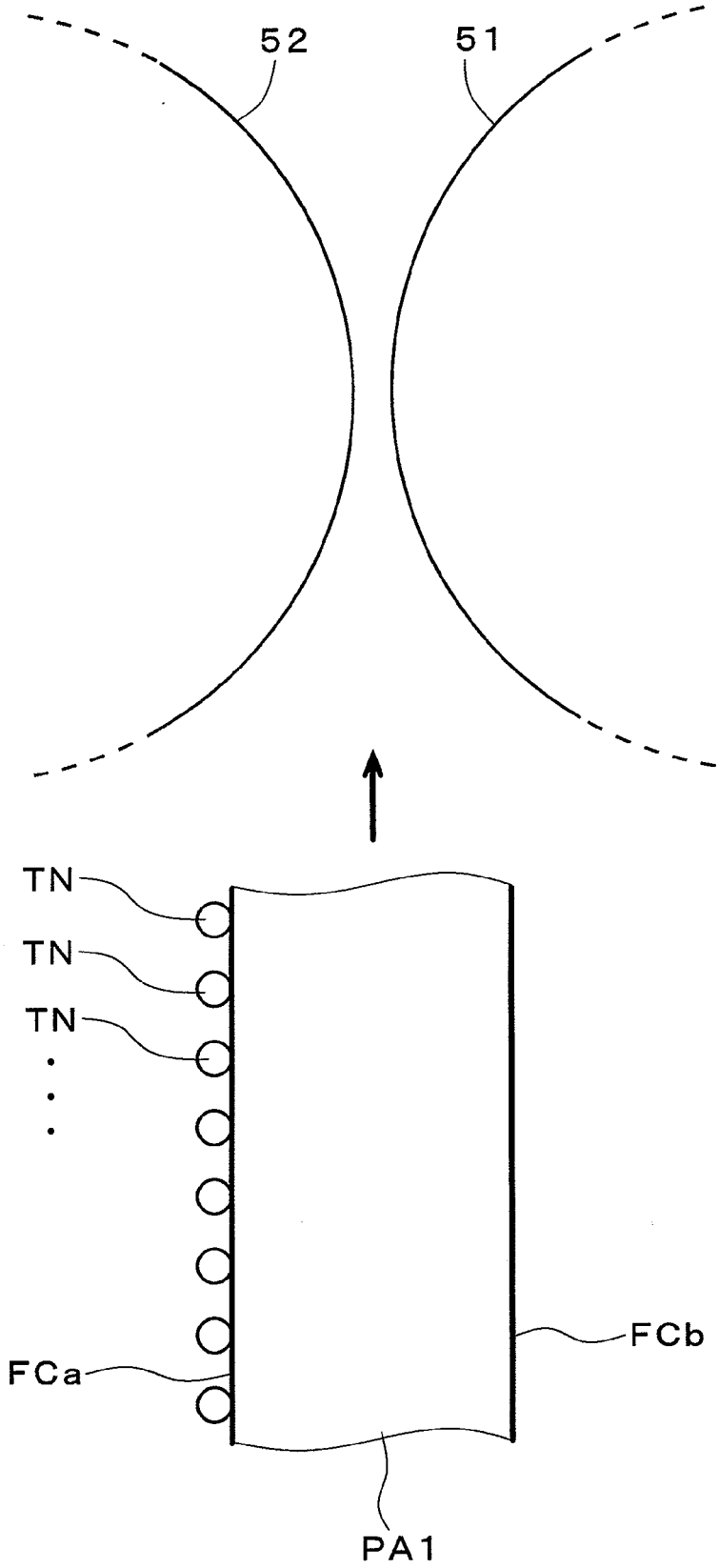
FIG. 4 is a cross section of a sheet of paper (relatively thick sheet of paper) immediately after transfer.
Figure 8:
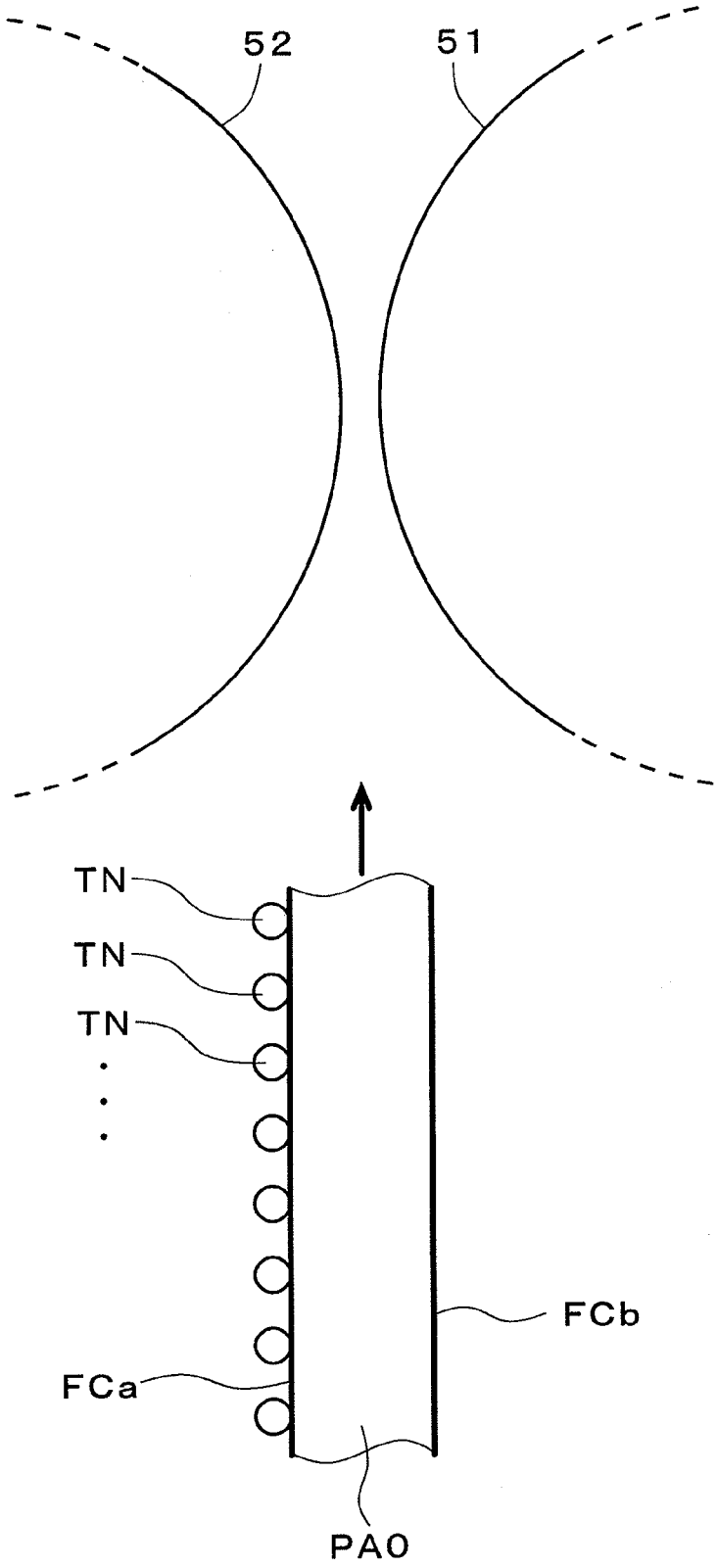
FIG. 8 is a cross section of a sheet of paper (relatively thin sheet of paper) immediately after transfer.

FIGS. 4 and 8 are views showing a state immediately after the transfer by the transfer roller 43 (and before the fixing). Specifically, FIG. 4 shows a state where toner particles TN forming the toner image are transferred onto the thick sheet of paper PA1, and FIG. 8 shows a state where toner particles TN forming the toner image are transferred onto the thin sheet of paper PA0. The sheet of paper PA on which the toner image is transferred goes upward in the vertical direction (to the upper side of the figures) in the apparatus 1 as shown in FIGS. 4 and 8.

Figure 5:
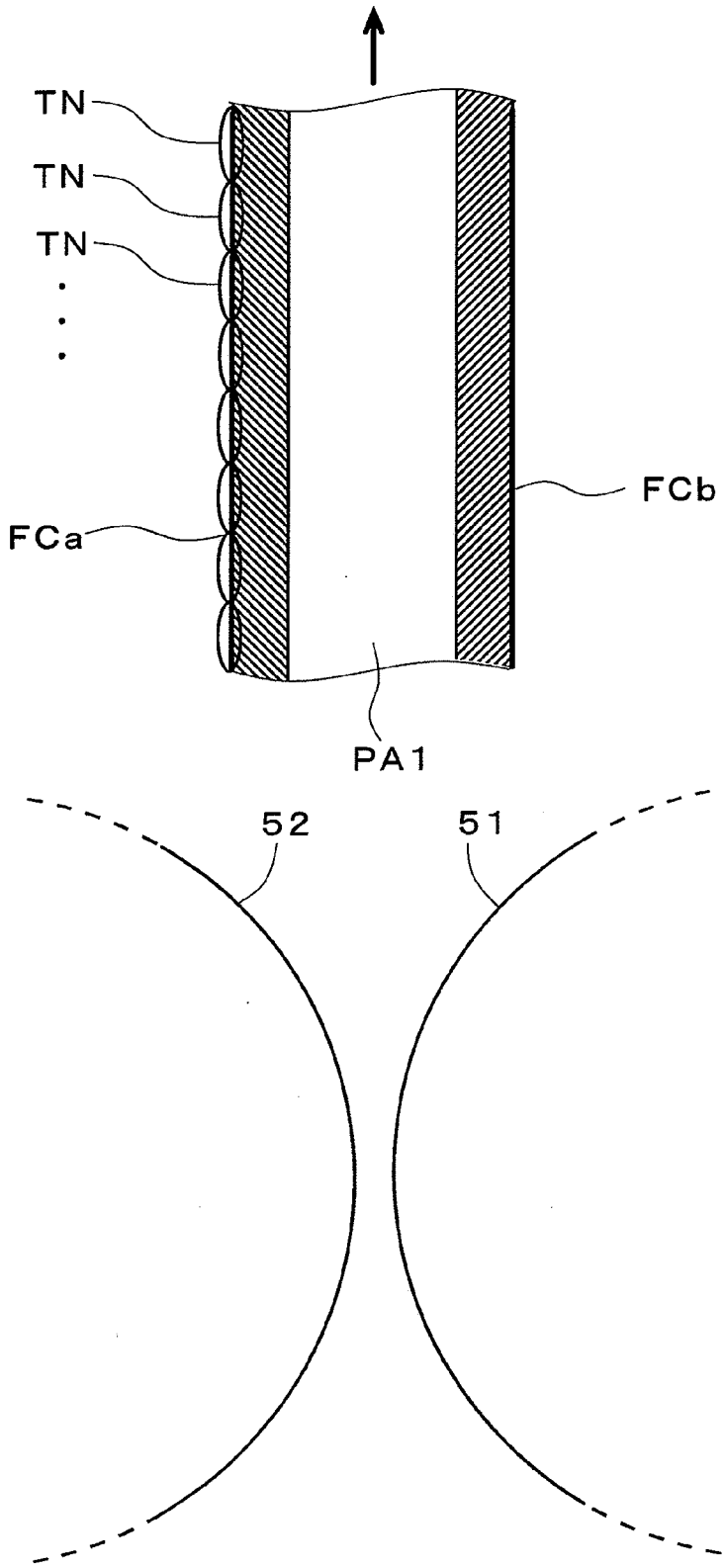
FIG. 5 is a cross section of a sheet of paper (relatively thick sheet of paper) immediately after fixing.
Figure 9:
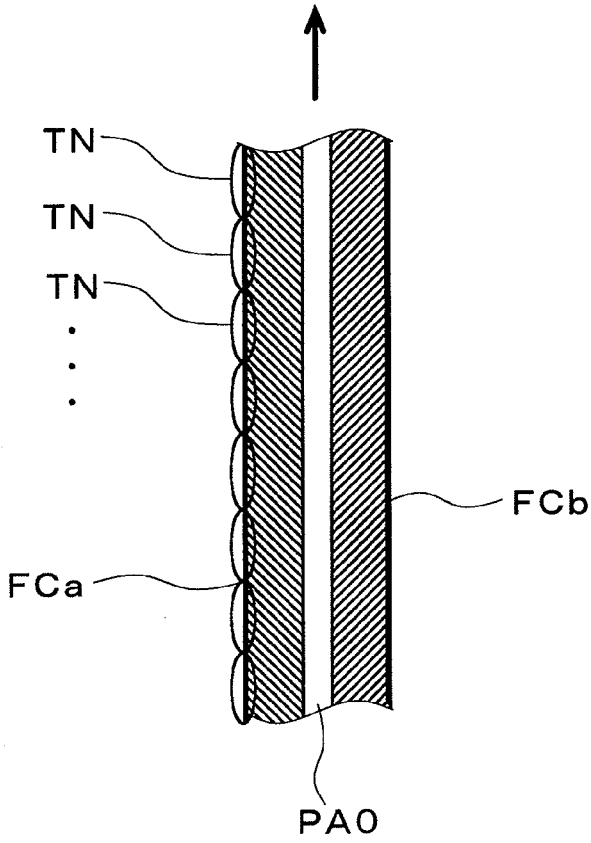
FIG. 9 is a cross section of a sheet of paper (relatively thin sheet of paper) immediately after fixing.
Figure 9:
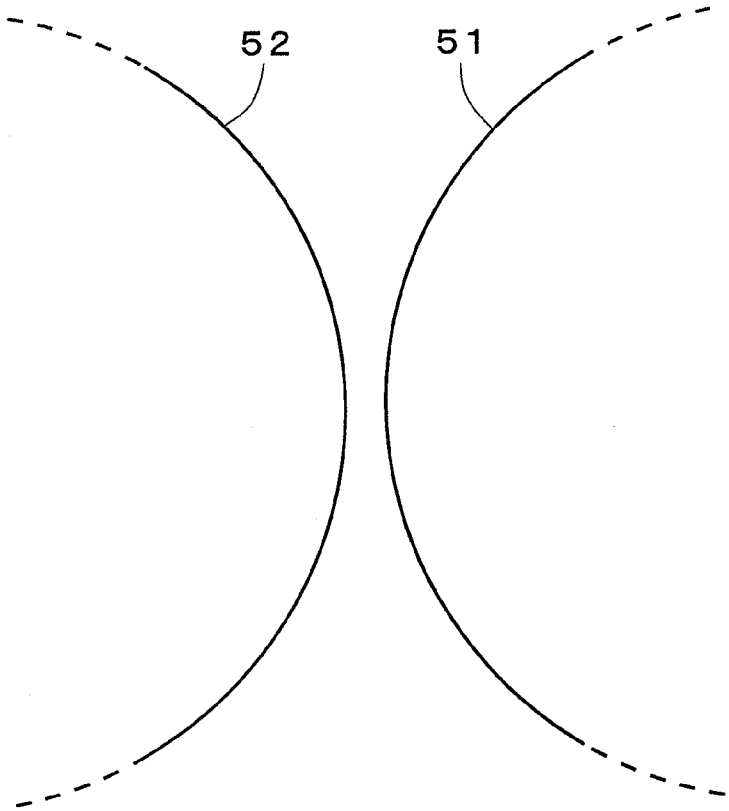

FIGS. 5 and 9 are views showing a state immediately after the respective sheets of paper PA1 and PA0 pass through the fixing part 50 (in more detail, through a portion between the opposed fixing rollers 51 and 52). Specifically, FIG. 5 shows a state immediately after the thick sheet of paper PA1 passes through the fixing part 50, and FIG. 9 shows a state immediately after the thin sheet of paper PA0 passes through the fixing part 50.

As shown in FIGS. 5 and 9, by giving heat to the sheet of paper PA from the fixing rollers 51 and 52, the toner particles on the sheet of paper PA are heat fused and the toner particles (i.e., the toner image) TN are fixed on the sheet of paper PA. In such a fixing operation, with the heat given by the fixing rollers 51 and 52, the temperature of the toner surface of the sheet of paper PA is increased up to a predetermined temperature TM1. The hatched portion in each of FIGS. 5 and 9 schematically represents the state where heat is given thereto.

Since the thick sheet of paper is thicker than the thin sheet of paper, even if the same amount of heat is given to the thick sheet of paper and the thin sheet of paper, the thick sheet of paper and the thin sheet of paper are different from each other in the degree to which the heat is diffused into the inside. Specifically, since the heat capacity of the thick sheet of paper is larger than that of the thin sheet of paper and the amount of heat to be diffused from the surface of the thick sheet of paper into the inside thereof is larger than the amount of heat to be diffused from the surface of the thin sheet of paper into the inside thereof, the surface temperature of the thick sheet of paper is harder to increase than that of the thin sheet of paper. For this reason, generally, the conveyance speed for the sheet of paper PA in the vicinity of the fixing part is decreased and the amount of heat given per unit of time is increased in the fixing process on the thick sheet of paper as compared with in the fixing process on the thin sheet of paper. With this operation, even in the fixing process on the thick sheet of paper, it is possible to increase the heated temperature of the surface of the sheet of paper PA up to the predetermined value TM1.

In this case, however, since the conveyance speed for the sheet of paper in the vicinity of the fixing part decreases, the print speed for the total sheets of paper PA (the number of sheets to be printed per unit of time) also decreases. In other words, the print speed for the thick sheet of paper decreases.

Then, the image forming apparatus 1 of this preferred embodiment conveys the thick sheet of paper PA1 at a high speed (specifically, at the speed of a predetermined value VT1 or more) in the vicinity of the fixing part 50 without decreasing the conveyance speed for the thick sheet of paper PA1. More specifically, with the intention of achieving the print speed for the thick sheet of paper as high as that for the thin sheet of paper, the thick sheet of paper PA1 and the thin sheet of paper PA0 are each conveyed at a high conveyance speed V1 (>VT1). For example, the value VT1 is about 150 mm/sec and the value V1 is about 160 mm/sec. As discussed above, the image forming apparatus 1 is configured to allow the multistep change of the conveyance speed for the sheet of paper PA, and it is therefore possible to set the conveyance speed for the thick sheet of paper PA1 to a value smaller than that of the conveyance speed for the thin sheet of paper PA0. Herein, however, the image forming apparatus 1 (though it has such a configuration) sets the conveyance speed for the thick sheet of paper PA1 to the speed V1 (in more detail, high conveyance speed) as high as the conveyance speed for the thin sheet of paper PA0 in order to avoid the decrease in the print speed.

Moreover, the image forming apparatus 1 sets the temperature TR1 of the fixing part 50 (specifically, the fixing rollers 51 and 52) in the fixing of the thick sheet of paper PA1 to a value larger than the temperature TR0 of the fixing part 50 in the fixing of the thin sheet of paper PA0 (TR1>TR0). It is thereby possible to increase the temperature of the toner surface of the sheet of paper PA up to the predetermined value TM1 even in the high-speed conveyance of sheet of paper. Therefore, as to the thick sheet of paper, it is also possible to reliably fix the toner image onto the sheet of paper PA while achieving a desired print speed.

In the continuous printing, a plurality of printed matters (sheets of paper) are stacked on the paper output tray 61. At that time, as discussed earlier, since the temperature of each sheet of paper on the paper output tray 61 is increased through the fixing process by the fixing part 50, degradation of the image may occur through adhesion of the toner image of one sheet of paper to another sheet of paper, or the like.

In order to avoid such degradation of the image, in this preferred embodiment, the fan 55 blows air to the sheet of paper PA to cool the sheet of paper PA. In this case, the fan 55 blows air to a surface on the reverse side of the surface on which the toner has been fixed immediately before this time. Specifically, the fan 55 provided over the sheet of paper PA in the vicinity of the paper output rollers 57 blows air to cool the upper-side surface of the sheet of paper PA. In the continuous printing, when an upper sheet of paper PA is stacked on a lower sheet of paper PA, if the upper-side surface FCb of the lower sheet of paper PA (see FIGS. 7 and 11) is cooled, the heat from the lower-side surface FCa of the next sheet of paper (the upper sheet of paper) PA is easy to be absorbed by the upper-side surface FCb of the lower sheet of paper PA. Therefore, a local increase in temperature is suppressed and toner fusing is hard to occur between the upper-side surface FCb of the lower sheet of paper PA and the lower-side surface FCa of the upper sheet of paper PA. Therefore, it is possible to prevent toner adhesion between adjacent sheets of paper PA and prevent degradation of the image.

The inventor has learned, however, that when the same amount of air is blown to both the thick paper and the plain paper in the fixing process accompanying high-speed conveyance, either one type of paper cannot be appropriately cooled. This problem will be discussed later.

Then, the image forming apparatus 1 of this preferred embodiment changes the amount F of air to be blown from the fan 55 in accordance with the basis weight of the sheet of paper PA (in other words, the thickness of the sheet of paper PA). More specifically, the image forming apparatus 1 sets the amount F1 of air to be blown in a case where the basis weight of the sheet of paper PA is larger than a threshold value TH (e.g., a value TH1 discussed later) to a value smaller than the amount F0 of air to be blown (F1<F0). Herein, the value F0 represents the amount F of air to be blown in a case where the basis weight of the sheet of paper PA is smaller than the threshold value TH. In more detail, the amount F1 of air to be blown to the thick sheet of paper PA1 is reduced to a value obtained by multiplying the amount F0 of air to be blown to the thin sheet of paper PA0 by a predetermined ratio (e.g., 90%). This allows an appropriate cooling operation on the basis of the appropriate amount of air to be blown.

Hereinafter, such a cooling operation for paper will be discussed.

In the high-speed conveyance of this preferred embodiment, as shown in FIGS. 5 and 9, heat is given to surface layer portions of both sides FCa and FCb of a sheet of paper PA and therearound. Specifically, heat is given from the fixing roller 51 to the surface layer portion of the face FCb which comes into contact with the fixing roller 51 (the face on the reverse side of the face to be subjected to the fixing process) and heat is given from the fixing roller 52 to the surface layer portion of the face FCa which comes into contact with the fixing roller 52 (the face to be subjected to the fixing process).

Figure 6:
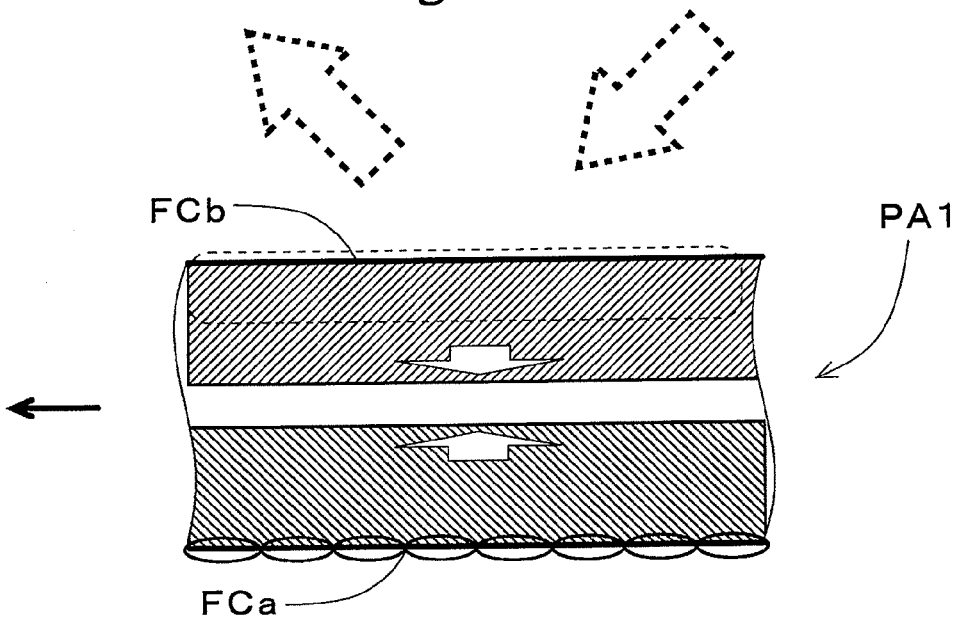
FIG. 6 is a view showing a manner where heat is diffused in the relatively thick sheet of paper after a fixing process.

After that, the sheet of paper PA having passed through the fixing part 50 reaches the vicinity of the paper output rollers 57 (see FIGS. 6 and 10) with the conveyance direction changed from the substantially vertical direction (the up-down direction of FIG. 5 and the like) to the substantially horizontal direction (the left-right direction of FIG. 6 and the like). As the sheet of paper PA is conveyed, the toner surface immediately after the fixing process is moved from the left side in FIG. 5 (and FIG. 9) to the lower side in FIG. 6 (and FIG. 10).

Figure 10:
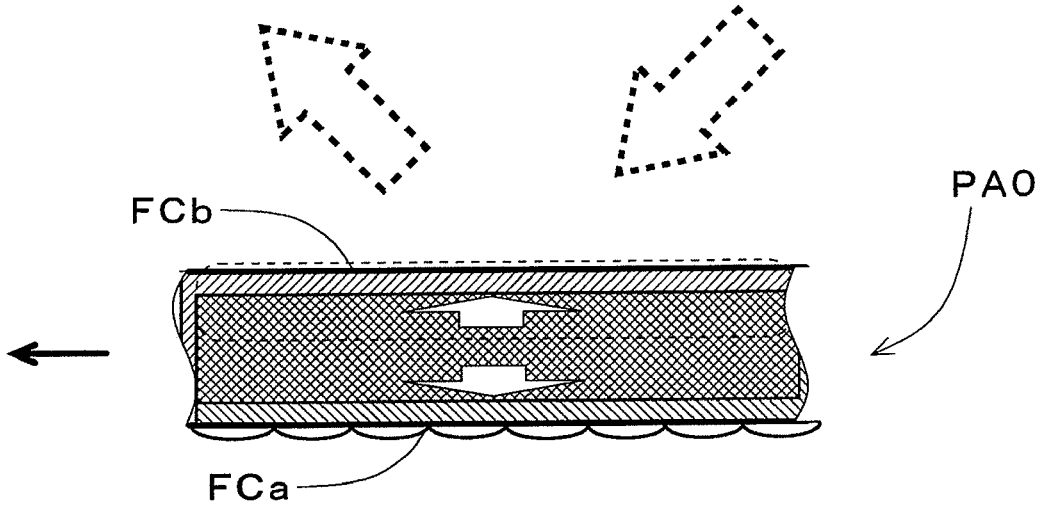
FIG. 10 is a view showing a manner where heat is diffused in the relatively thin sheet of paper after a fixing process.

As shown in FIGS. 6 and 10, the heat from the fixing roller 51 is gradually diffused from the surface FCb of the sheet of paper PA into the inside thereof. In FIGS. 6 and 10, the hatched portion in FIGS. 5 and 9 is expanded (toward the inside of paper) and this represents "the diffusion of heat".

Since the heat capacity of the thick sheet of paper is larger than that of the thin sheet of paper, when the sheet of paper PA is a thick sheet of paper PA1, the temperature of the sheet of paper PA (thick sheet of paper PA1) immediately after the fixing process is relatively suppressed. More specifically, in the thick sheet of paper PA1, heat is diffused from the respective surface layer portions of both the sides FCa and FCb of the thick sheet of paper PA1 into a deep layer portion thereof further inside and the temperatures of the surface layer portions of the sheet of paper PA is relatively hard to increase.

On the other hand, since the heat capacity of the thin sheet of paper is smaller than that of the thick sheet of paper, when the sheet of paper PA is a thin sheet of paper PA0, the temperature of the sheet of paper PA (thin sheet of paper PA0) immediately after the fixing process becomes relatively high. More specifically, in the thin sheet of paper PA0, heat is diffused from the respective surface layer portions of both the sides FCa and FCb of the thin sheet of paper PA0 into a deep layer portion thereof further inside and the heat reaches the surface layer portions of the reverse sides or near the surface layer portions.

For example, the heat given by the fixing roller 52 is diffused from the surface layer portion of the side FCa of the thin sheet of paper PA0 into the deep layer portion thereof further inside and further reaches near the surface layer portion of the reverse side FCb. Particularly, since the thin sheet of paper PA0 is thinner than the thick sheet of paper PA1, the heat is easy to reach from one-side surface (e.g., the lower-side surface FCa in FIG. 10) to the reverse-side surface (e.g., the upper-side surface FCb in FIG. 10). The same applies to the heat given by the fixing roller 51. The heat given by the fixing roller 51 is diffused from the surface layer portion of the side FCb of the thin sheet of paper PA0 into the deep layer portion thereof further inside and further reaches near the surface layer portion of the reverse side FCa. Therefore, the temperatures of the surface layer portions of both the sides FCa and FCb of the sheet of paper PA are easy to increase.

Then, by applying the air blown from the fan 55 to the respective surfaces FCb of the sheets of paper PA1 and PA0 in such a state, the surfaces FCb are cooled (see broken-line arrows in FIGS. 6 and 10).

Figure 7:
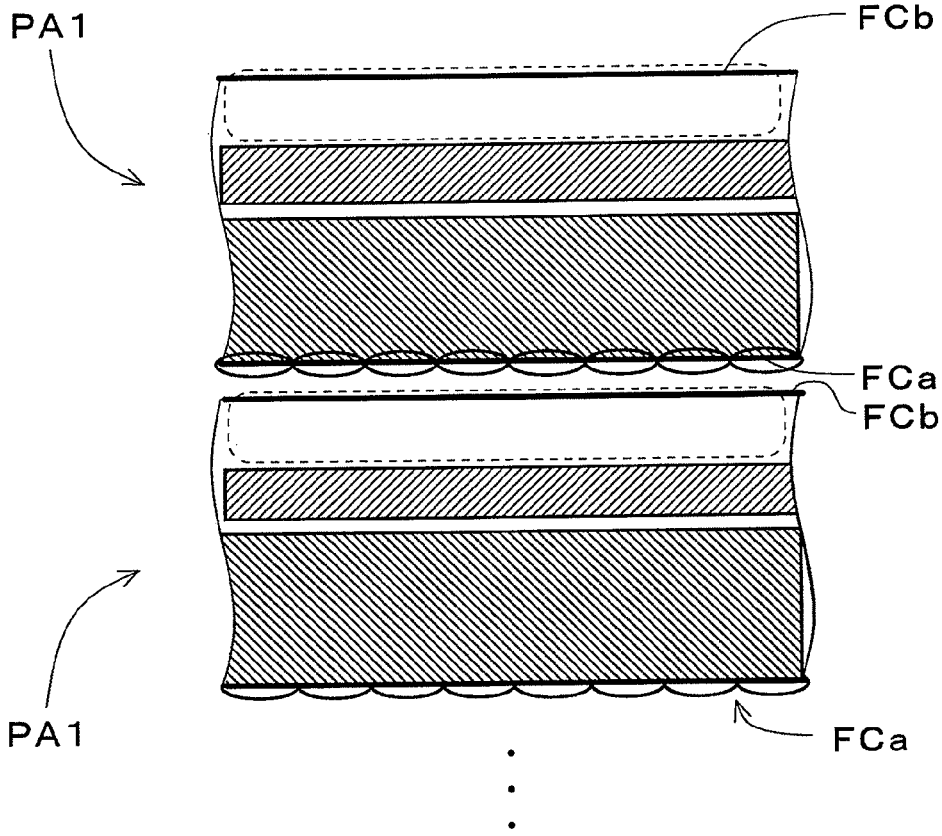
FIG. 7 is a view showing a manner where the relatively thick sheet of paper is cooled.
Figure 11:
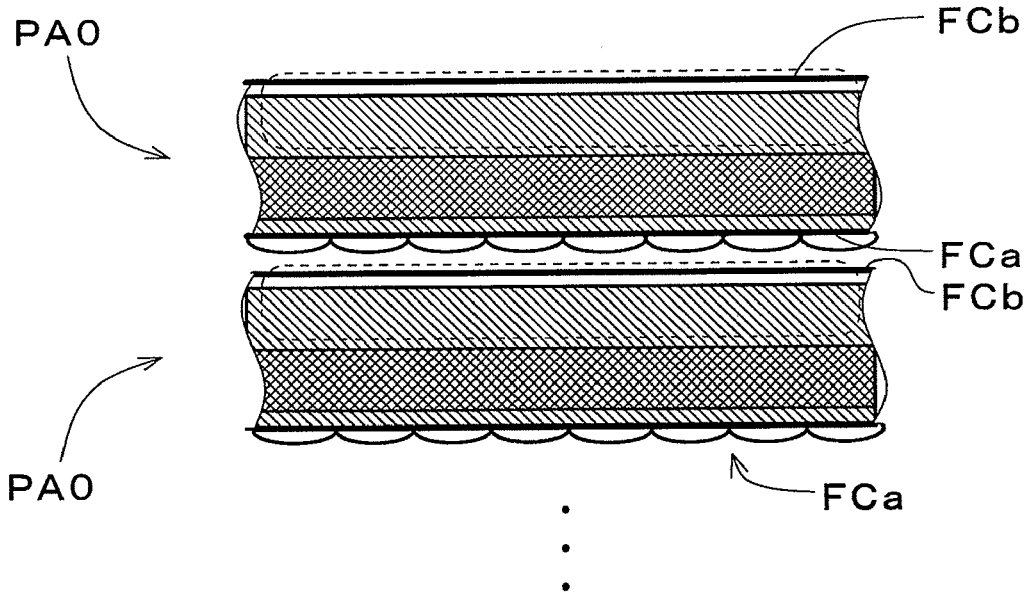
FIG. 11 is a view showing a manner where the relatively thin sheet of paper is cooled.

FIGS. 7 and 11 are views showing such a cooling manner. Herein, assumed is a case where the amount of air to be blown to the thick sheet of paper PA1 and that to the thin sheet of paper PA0 are equal to each other. In FIGS. 7 and 11, the heat lost by air cooling is schematically represented by a broken-line rectangle region (and the area thereof).

In this case, as shown in FIG. 7, the heat near the surface FCb of the thick sheet of paper PA1 is lost by the air blown to the thick sheet of paper PA1 and the temperature of the surface FCb decreases. In other words, the surface FCb of the thick sheet of paper PA1 is cooled.

On the other hand, as shown in FIG. 11, the heat near the surface FCb of the thin sheet of paper PA0 is lost by the air blown to the thin sheet of paper PA0. Since the heat given from the fixing roller 52 to the reverse-side surface FCa also reaches the surface FCb of the thin sheet of paper PA0, however, the surface FCb of the sheet of paper PA0 is not always sufficiently cooled.

Considering such a condition, by increasing the amount F of air to be blown to the thin sheet of paper PA0 up to, e.g., the value F0, it is possible to sufficiently lose the heat of the surface FCb of the thin sheet of paper PA0 and sufficiently cool the surface FCb.

If the same value as the amount F of air to be blown to the thin sheet of paper PA0 (for example, the value F0) is adopted as the amount F of air to be blown to the thick sheet of paper PA1, however, the surface FCb of the thick sheet of paper PA1 is excessively cooled. When an abrupt change in the amount of heat occurs due to the excessive cooling, there arises a problem of causing a curl in the paper, or the like.

Thus, from his own examination, the inventor has learned that when the same amount of air is blown to both the thick paper and the plain paper in the fixing process accompanying high-speed conveyance, either one type of paper cannot be appropriately cooled.

The image forming apparatus 1 of this preferred embodiment sets the amount F1 of air to be blown to the thick sheet of paper PA1 to a value smaller than the amount F0 of air to be blown to the thin sheet of paper PA0. With this operation, it is possible to appropriately cool the thin sheet of paper PA0 while avoiding excessive cooling of the thick sheet of paper PA1. This suppresses occurrence of curls in the sheet of paper PA. In this preferred embodiment, an appropriate cooling operation can be performed on the basis of an appropriate amount of air to be blown. It is also possible to suppress an increase in the power consumption.

Further, in this preferred embodiment, the amount F of air to be blown is finely controlled in accordance with the degree of thickness of the sheet of paper PA. As the sheet of paper PA becomes thicker, since the heat capacity of the sheet of paper PA increases, the heat becomes easier to be diffused from the surface layer portion of the sheet of paper PA into the inside (the deep layer portion) of the sheet of paper PA. Therefore, as the thickness of the sheet of paper PA becomes larger, the surface temperature of the sheet of paper PA is hard to increase. Considering such special characteristics, herein, the amount F of air to be blown is decreased as the thickness of the sheet of paper PA becomes larger.

In the apparatus disclosed in Patent Document 1, the amount of air to be blown from the cooling fan is made relatively larger when OHP sheets (relatively thick sheets of paper) are outputted, and the amount of air to be blown from the cooling fan is made relatively smaller when sheets of plain paper (relatively thin sheets of paper) are outputted. In contrast, in the image forming apparatus of this preferred embodiment, conversely, the amount of air to be blown from the fan 55 is made relatively smaller when relatively thick sheets of paper are outputted, and the amount of air to be blown from the fan 55 is made relatively larger when relatively thin sheets of paper are outputted. Thus, the principle of this preferred embodiment of the present invention is absolutely different from that of the above prior arts (particularly, Patent Document 1).

<3. Detailed Operation>

Figure 12:
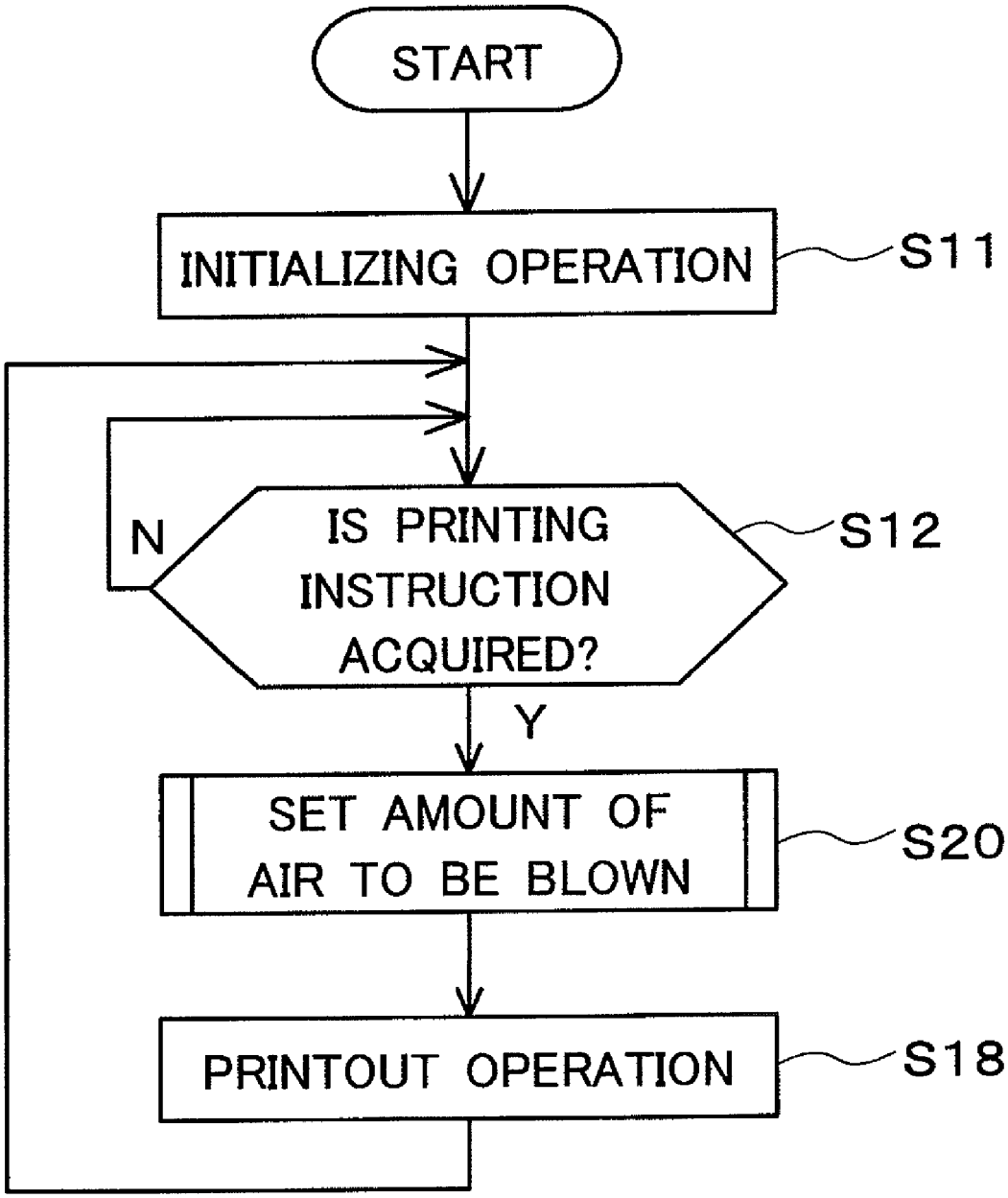
FIG. 12 is a flowchart showing a detailed operation.
Figure 13:
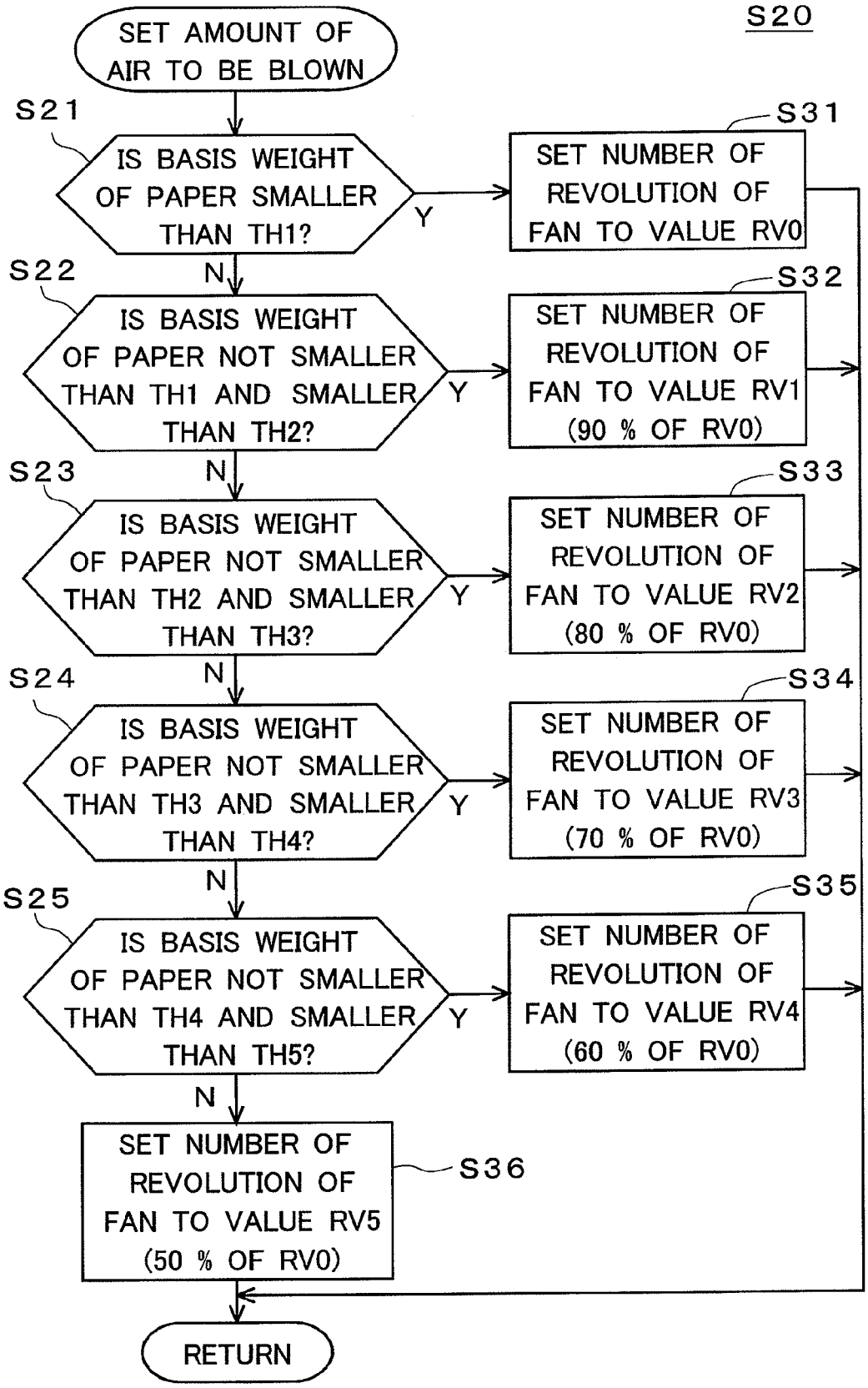
FIG. 13 is a flowchart showing a detailed operation.

FIGS. 12 and 13 are flowcharts showing a detailed operation of this preferred embodiment.

As shown in FIG. 12, after power-on, first, an initializing operation is started (Step S11). The initializing operation includes an operation of raising the temperature of the fixing part 50, and the like.

After the initializing operation is finished, the image forming apparatus 1 is brought into a reception waiting state to wait for reception of a printing instruction (Step S12).

When the printing instruction is received in the reception waiting state, the process goes to Step S12 to Step S20 (also see FIG. 13). FIG. 13 shows a flowchart of the detailed operation of Step S20.

In Steps S21 to S25 and S31 to S36 of FIG. 13, branch operations in accordance with the basis weight of the sheet of paper PA are performed, and the number of revolution of the fan 55 is determined and set in accordance with the basis weight of the sheet of paper PA. The amount of air blown from the fan 55 increases as the number of revolution of the fan 55 becomes larger, and the amount of air blown from the fan 55 decreases as the number of revolution of the fan 55 becomes smaller.

Specifically, when the basis weight of the sheet of paper PA is smaller than a value TH1 (e.g., 64 g/m$^2$), the process goes from Step S21 to Step S31 and the number of revolution of the fan 55 is determined to be a value RV0. When the fan 55 rotates with the number of revolution set to RV0, the air corresponding to the amount F0 is blown to the sheet of paper PA from the fan 55. In other words, the number of revolution set to RV0 corresponds to the amount F0 of air blown from the fan 55.

When the basis weight of the sheet of paper PA is not smaller than the value TH1 and smaller than a value TH2 (e.g., 91 g/m$^2$), the process goes from Step S22 to Step S32 and the number of revolution of the fan 55 is determined to be a value RV1. The value RV1 is, for example, 90% of the value RV0 (RV1=0.9×RV0).

When the basis weight of the sheet of paper PA is not smaller than the value TH2 and smaller than a value TH3 (e.g., 121 g/m$^2$), the process goes from Step S23 to Step S33 and the number of revolution of the fan 55 is determined to be a value RV2. The value RV2 is, for example, 80% of the value RV0 (RV2=0.8×RV0).

When the basis weight of the sheet of paper PA is not smaller than the value TH3 and smaller than a value TH4 (e.g., 157 g/m$^2$), the process goes from Step S24 to Step S34 and the number of revolution of the fan 55 is determined to be a value RV3. The value RV3 is, for example, 70% of the value RV0 (RV3=0.7×RV0).

When the basis weight of the sheet of paper PA is not smaller than the value TH4 and smaller than a value TH5 (e.g., 211 g/m$^2$), the process goes from Step S25 to Step S35 and the number of revolution of the fan 55 is determined to be a value RV4. The value RV4 is, for example, 60% of the value RV0 (RV4=0.6×RV0).

When the basis weight of the sheet of paper PA is not smaller than the value TH5, the process goes from Step S25 to Step S36 and the number of revolution of the fan 55 is determined to be a value RV5. The value RV5 is, for example, 50% of the value RV0 (RV5=0.5×RV0).

After the setting operation in Steps S21 to S25 and S31 to S36 is finished, the process goes to Step S18.

In Step S18, the above-discussed electrophotographic printing operation is performed.

In more detail, the toner image of the color components superimposed on the intermediate transfer belt 21 is transferred onto the sheet of paper PA and a full color image is thereby formed on the sheet of paper PA. The toner image transferred to the sheet of paper PA is fixed on the sheet of paper PA by heating with the fixing part 50. As discussed above, in this preferred embodiment, it is assumed that the sheet of paper PA is always conveyed at a high speed (at the speed V1) regardless of the thickness of the sheet of paper PA to be printed.

Then, air is blown form the fan 55 through the air blowing opening 56 to the sheet of paper PA having passed through the fixing part 50 and reaching near the paper output roller 57. The sheet of paper PA having been subjected to the fixing process is thereby cooled. Particularly, as the number of revolution of the fan 55, the value set in any one of Steps S31 to S36 (any one of RV0 to RV5) is used. The amount of air to be blown from the fan 55 is thereby appropriately controlled in accordance with the basis weight of the sheet of paper PA (in other words, the thickness of the sheet of paper PA). It is therefore possible to appropriately cool the sheet of paper PA in accordance with the thickness of the sheet of paper PA.

The printing operation in Step S18 may be the single-sided printing or the double-sided printing. In any case, by performing the above-described cooling operation for paper, the sheet of paper PA can be appropriately cooled.

Thus, in this preferred embodiment, in a case where the sheet of paper PA passes through the fixing part 50 at the speed of the predetermined value VT1 or more, when the basis weight of the sheet of paper PA is larger than the threshold value TH (e.g., TH1), the amount F of air to be blown from the fan 55 is set to a value smaller than that in a case where the basis weight of the sheet of paper PA is smaller than the threshold value TH. In other words, when the sheet of paper PA passes through the fixing part 50 at a high speed, the value of the amount F of air to be blown in a case where the basis weight of the sheet of paper PA is larger than the threshold value TH is set to a value smaller than that of the amount of F of air to be blown in a case where the basis weight of the sheet of paper PA is smaller than the threshold value TH. Specifically, for example, the number RV1 of revolution of the fan 55 (in other words, the amount of air to be blown from the fan 55) in the case where the basis weight of the sheet of paper PA is larger than the threshold value TH1 and smaller than the threshold value TH2 is set to a value smaller than the number RV0 of revolution of the fan 55 in the case where the basis weight of the sheet of paper PA is smaller than the threshold value TH1 (RV1<RV0).

When the basis weight of the sheet of paper PA is larger than the threshold value TH2 (>TH1), the number RV of revolution of the fan 55 is set to a value smaller than that in a case where the basis weight of the sheet of paper PA is smaller than the threshold value TH2 (for example, set to the value RV2 smaller than the value RV1). In other words, the value of the amount F of air to be blown in a case where the basis weight of the sheet of paper PA is larger than the threshold value TH2 is set to a value smaller than that of the amount of F of air to be blown in a case where the basis weight of the sheet of paper PA is smaller than the threshold value TH2. Similarly, the value of the amount F of air to be blown in a case where the basis weight of the sheet of paper PA is larger than the threshold value TH3 is set to a value smaller than that of the amount of F of air in a case where the basis weight of the sheet of paper PA is smaller than the threshold value TH3. In other words, the amount of air to be blown from the fan 55 is set to a smaller value (in a stepwise manner) as the basis weight of the sheet of paper PA increases. Thus, since the amount of air to be blown from the fan 55 is finely controlled (in a multistep manner), it is possible to perform a more appropriate cooling operation.

The above-discussed principle also means that when a first transfer material (e.g., a thin sheet of paper PA0) which is a transfer material having a basis weight smaller than the threshold value TH and a second transfer material (e.g., a thick sheet of paper PA1) which is a transfer material having a basis weight larger than the threshold value TH each pass through the fixing part at substantially the same speed, the amount of air to be blown to the second transfer material is set to a value smaller than the amount of air to be blown to the first transfer material.

<4. Variations>

Though the preferred embodiment of the present invention has been discussed above, the present invention is not limited to the above-discussed preferred embodiment.

For example, though discussion has been made in the above-discussed preferred embodiment on the case where the amount F of air to be blown is controlled in six steps in accordance with the basis weight (thickness) of the sheet of paper PA, the present invention is not limited to this case. Specifically, the amount F of air to be blown may be controlled in five steps or less or in seven steps or more in accordance with the basis weight (thickness) of the sheet of paper PA. Particularly, the amount F of air to be blown may be controlled in two steps in accordance with the result of comparison between the basis weight of the sheet of paper PA and the single threshold value TH. Further, the threshold value TH is not limited to the above value TH1 but may be the above value TH2 or the like.

Though discussion has been made in the above-discussed preferred embodiment on the case where the fan 55 is provided over the conveyance path for paper and cools the upper-side surface (the surface on the reverse side of the surface to be subjected to the fixing process) of the sheet of paper PA, the present invention is not limited to this case. There may be a converse case, for example, where the fan 55 is provided below the conveyance path for paper and cools the lower-side surface (the surface to be subjected to the fixing process) of the sheet of paper PA. Alternatively, the fans 55 may be provided over and below the conveyance path for paper. In this case, the above-discussed principle is particularly useful when one of the fans 55 has the amount of air to be blown therefrom which is larger than that of the other fan 55.

Though discussion has been made in the above-discussed preferred embodiment on the case where both the fixing rollers 51 and 52 are heated by the incorporated heaters, the present invention is not limited to this case. The above-discussed principle can be applied to, for example, a case where only the fixing roller 52 out of the two fixing rollers 51 and 52 is heated by the heater. Also in this case, since the heat capacity of the thin sheet of paper PA0 is smaller than that of the thick sheet of paper PA1, considering the reachability in the case where the heat given from the fixing roller 52 to the contact surface FCa reaches the reverse-side surface FCb, the temperature of the surface FCb of the thin sheet of paper PA0 is easier to increase than that of the surface FCb of the thick sheet of paper PA1. Conversely, the temperature of the surface FCb of the thick sheet of paper PA1 is harder to increase than that of the surface FCb of the thin sheet of paper PA0. Therefore, like in the above-discussed preferred embodiment, the same effect can be produced by setting the amount F of air to be blown to the thick sheet of paper PA1 to a value smaller than the amount F of air to be blown to the thin sheet of paper PA0.

Though discussion has been made in the above-discussed preferred embodiment on the case where the conveyance speed for the thick sheet of paper PA1 and that for the thin sheet of paper PA0 are set to the same high-speed value V1 (>VT1), the present invention is not limited to this case. The above-discussed principle may be applied to, for example, a case where the conveyance speed for the thick sheet of paper PA1 is set to a value V2 (smaller than the value VT1) which is substantially the same as the conveyance speed for the thin sheet of paper PA0.

Though discussion has been made in the above-discussed preferred embodiment on the case where the basis weight of the sheet of paper PA (the thickness of the sheet of paper PA) is detected by the sensor 35, the present invention is not limited to this case. The basis weight may be detected by other methods.

For example, the image forming apparatus 1 may acquire the basis weight of the sheet of paper PA on the basis of input information on the basis weight of the sheet of paper PA.

Specifically, the basis weight of the sheet of paper PA may be acquired on the basis of the content of a print setting instruction given by an operator to the image forming apparatus 1. In more detail, the image forming apparatus 1 may acquire the basis weight of the sheet of paper PA on the basis of print setting information (paper type information indicating "plain paper", "thick paper" or the like, and the like) inputted by the operator of the image forming apparatus 1, using an operation input part (not shown) of the image forming apparatus 1.

Alternatively, the basis weight of the sheet of paper PA may be acquired on the basis of the content of print setting included in the printing instruction transmitted from the information processing apparatus (personal computer or the like) which is a requester of the printout operation. In more detail, the image forming apparatus 1 may acquire the basis weight of the sheet of paper PA on the basis of the print setting information (paper type information and the like) set in the information processing apparatus which is the requester of the printout operation, by an operator of the information processing apparatus, using a setting screen for printer drivers.

Though discussion has been made in the above-discussed preferred embodiment on a tandem-type color printer as an example of the image forming apparatus, the present invention is not limited to this case. The above-discussed principle may be applied to other types of printers (a four-cycle color printer or a monochrome printer) or the like.

While the invention has been shown and described in detail, the foregoing description is in all aspects illustrative and not restrictive. It is therefore understood that numerous modifications and variations can be devised without departing from the scope of the invention.

What is claimed is:

1. An image forming apparatus, comprising:

a fixing part for fixing a toner image formed on a transfer material to said transfer material;

a fan provided on a downstream side of said fixing part, for blowing air to said transfer material having passed through said fixing part; and an airflow control part for controlling an amount of air to be blown from said fan, wherein when a basis weight of said transfer material is larger than a first threshold value, said airflow control part sets said amount of air to be blown to a value smaller than that in a case where the basis weight of said transfer material is smaller than said first threshold value, and when the basis weight of said transfer material is larger than a second threshold value which is larger than said first threshold value, said airflow control part sets said amount of air to be blown to a value smaller than that in a case where the basis weight of said transfer material is smaller than said second threshold value.

2. The image forming apparatus according to claim 1, wherein said fan is provided on the downstream side of said fixing part, said fan facing one side of said transfer material.

3. The image forming apparatus according to claim 1, further comprising a detection part for detecting the basis weight of said transfer material, wherein said airflow control part determines the amount of air to be blown in accordance with the basis weight detected by said detection part.

4. The image forming apparatus according to claim 1, further comprising an acquisition part for acquiring input information on the basis weight of said transfer material, wherein said airflow control part determines the amount of air to be blown in accordance with the basis weight acquired by said acquisition part.

5. The image forming apparatus according to claim 1, wherein in a case where said transfer material passes through said fixing part at a speed not lower than a predetermined value, when the basis weight of said transfer material is larger than said first threshold value, said airflow control part sets said amount of air to be blown to a value smaller than that in a case where the basis weight of said transfer material is smaller than said first threshold value.

6. An image forming method, comprising the steps of:

fixing a toner image formed on a transfer material to said transfer material by using a fixing part; and blowing air to said transfer material having passed through said fixing part by using a fan provided on a downstream side of said fixing part, wherein when a basis weight of said transfer material is larger than a first threshold value, an amount of air to be blown from said fan is set to a value smaller than that in a case where the basis weight of said transfer material is smaller than said first threshold value, and when the basis weight of said transfer material is larger than a second threshold value which is larger than said first threshold value, said amount of air to be blown is set to a value smaller than that in a case where the basis weight of said transfer material is smaller than said second threshold value.

7. The image forming method according to claim 6, wherein said fan is provided on the downstream side of said fixing part, said fan facing one side of said transfer material.

8. The image forming method according to claim 6, wherein said amount of air to be blown is determined in accordance with the basis weight detected by a detection part for detecting the basis weight of said transfer material.

9. The image forming method according to claim 6, wherein said amount of air to be blown is determined in accordance with the basis weight acquired as input information on the basis weight of said transfer material.

10. The image forming method according to claim 6, wherein in a case where said transfer material passes through said fixing part at a speed not lower than a predetermined value, when the basis weight of said transfer material is larger than said first threshold value, said amount of air to be blown is set to a value smaller than that in a case where the basis weight of said transfer material is smaller than said first threshold value.

* * * * *